US007848921B2

(12) United States Patent
Ehara

(10) Patent No.: US 7,848,921 B2
(45) Date of Patent: Dec. 7, 2010

(54) LOW-FREQUENCY-BAND COMPONENT AND HIGH-FREQUENCY-BAND AUDIO ENCODING/DECODING APPARATUS, AND COMMUNICATION APPARATUS THEREOF

(75) Inventor: Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 881 days.

(21) Appl. No.: 11/573,765

(22) PCT Filed: Aug. 29, 2005

(86) PCT No.: PCT/JP2005/015643

§ 371 (c)(1),
(2), (4) Date: Feb. 15, 2007

(87) PCT Pub. No.: WO2006/025313

PCT Pub. Date: Mar. 9, 2006

(65) Prior Publication Data

US 2007/0299669 A1 Dec. 27, 2007

(30) Foreign Application Priority Data

Aug. 31, 2004 (JP) ..... 2004-252037

(51) Int. Cl.
*G10L 19/00* (2006.01)

(52) U.S. Cl. ..... 704/216

(58) Field of Classification Search ..... 704/216–219, 704/500

See application file for complete search history.

(56) References Cited

U.S. PATENT DOCUMENTS 4,757,517 A 7/1988 Yatsuzuka
6,208,957 B1 3/2001 Nomura
6,330,534 B1 12/2001 Yasunaga et al.
6,757,650 B2 6/2004 Yasunaga et al.

(Continued)

FOREIGN PATENT DOCUMENTS

EP 1158495 11/2001

(Continued)

OTHER PUBLICATIONS

Yao et al., "Wideband speech compression using CELP and wavelet transform", Signal Processing, 1996., 3RD International Conference on Beijing, China Oct. 14-18, 1996, New York, NY, USA, IEEE, US, vol. 1, Oct. 14, 1996, pp. 706-709, XP010209605.

(Continued)

*Primary Examiner*—Michael N Opsasnick
(74) *Attorney, Agent, or Firm*—Greenblum & Bernstein, P.L.C.

(57) ABSTRACT

An audio encoding apparatus capable of improving a frame cancellation error tolerance without increasing a number of bits of a fixed codebook in a CELP type audio encoding. A linear prediction analyzer analyzes an input digital speech signal and outputs linear predictive coefficients. A linear predictive coefficients quantizer quantizes the linear predictive coefficients. A low-frequency-band component encoder encodes a down-sampled linear-predictive residual signal by a pulse-code-modulation encoder and generates low-frequency-band component encoded information, while a high-frequency-band component encoder encodes an error signal between a linear-predictive residual signal and an up-sampled signal of a decoded down-sampled linear-predictive residual signal by a code-excited-linear-prediction encoder and generates high-frequency-band component encoded information.

7 Claims, 6 Drawing Sheets

U.S. PATENT DOCUMENTS

| | | | | |
|---|---|---|---|---|
| 6,895,375 | B2 * | 5/2005 | Malah et al. | 704/219 |
| 6,910,008 | B1 | 6/2005 | Yasunaga et al. | |
| 6,988,066 | B2 * | 1/2006 | Malah | 704/219 |
| 7,136,810 | B2 * | 11/2006 | Paksoy et al. | 704/219 |
| 7,216,074 | B2 * | 5/2007 | Malah et al. | 704/205 |
| 7,272,556 | B1 * | 9/2007 | Aguilar et al. | 704/230 |
| 7,330,814 | B2 * | 2/2008 | McCree | 704/219 |
| 2002/0052738 | A1 * | 5/2002 | Paksoy et al. | 704/219 |
| 2002/0077812 | A1 | 6/2002 | Suzuki et al. | |
| 2003/0093278 | A1 * | 5/2003 | Malah | 704/265 |
| 2005/0165603 | A1 * | 7/2005 | Bessette et al. | 704/200.1 |
| 2006/0235682 | A1 | 10/2006 | Yasunaga et al. | |

FOREIGN PATENT DOCUMENTS

| | | |
|---|---|---|
| EP | 1202251 | 5/2002 |
| EP | 1431962 | 6/2004 |
| GB | 2188820 | 10/1987 |
| JP | 11-030997 | 2/1999 |
| JP | 2001-337700 | 12/2001 |
| JP | 2002-202799 | 7/2002 |

OTHER PUBLICATIONS

Koishida et al., "Enhancing MPEG-4 celp by jointly optimized inter/intra-frame LSP predictors", Speech Coding, 2000. Proceedings. 2000 IEEE Workshop on Sep. 17-20, 2000, Piscataway, NJ, USA, IEEE, Sep. 17, 2000, pp. 90-92, XP010520051.

English Language Abstract of JP 11-030997, Feb. 2, 1999.

U.S. Appl. No. 11/573,761 to Ehara et al., filed Feb. 15, 2007.

U.S. Appl. No. 11/508,852 to Yasunaga et al., filed Aug. 24, 2006.

* cited by examiner

LOW-FREQUENCY-BAND COMPONENT AND HIGH-FREQUENCY-BAND AUDIO ENCODING/DECODING APPARATUS, AND COMMUNICATION APPARATUS THEREOF

TECHNICAL FIELD

The present invention relates to a speech encoding apparatus, speech decoding apparatus, communication apparatus and speech encoding method using a scalable encoding technique.

BACKGROUND ART

Conventionally, in a mobile radio communication system and the like, a CELP (Code Excited Linear Prediction) scheme has been widely used as an encoding scheme for speech communication, since speech signals can be encoded with high quality at relatively low bit rates (about 8 kbit/s in telephone band speech). Meanwhile, in recent years, speech communication (VoIP: Voice over IP) using an IP (Internet Protocol) network is rapidly becoming widespread, and it is foreseen that the technique of VoIP will be used widely in the mobile radio communication system.

In packet communication typified by IP communication, since packets are sometimes lost on the transmission path, a scheme that is robust against frame loss is preferable as a speech encoding scheme. Herein, in the CELP scheme, since a current speech signal is encoded using an adaptive codebook that is a buffer of an excitation signal that was quantized in the past, when an error once occurs on the transmission path, the contents of the adaptive codebook on the encoder side (transmission side) and the decoder side (reception side) fail to be synchronized, and the error influences not only the frame where the error occurs on the transmission path, but also subsequent normal frames where the error does not occur on the transmission path. Therefore, the CELP scheme is not regarded as being very robust against frame loss.

As a method of enhancing the robustness against frame loss, for example, a method is known of performing decoding using another packet or a part of a frame when a packet or apart of the frame is lost. Scalable encoding (also referred to as embedded encoding or layered encoding) is one of techniques to implement such a method. The information encoded with the scalable encoding scheme is made up of core layer encoded information and enhancement layer encoded information. A decoding apparatus that receives the information encoded with the scalable encoding scheme is capable of decoding a speech signal that is at least essential to reproduce speech by using only the core layer encoded information even without the enhancement layer encoded information.

As an example of scalable encoding, there is an encoding scheme having scalability in frequency band of a signal which is target of encoding (for example, see Patent Document 1). In the technique as described in Patent Document 1, a down-sampled input signal is encoded in a first CELP encoding circuit, and the input signal is further encoded in a second CELP encoding circuit using an encoding result in the first circuit. According to the technique as described in Patent Document 1, by increasing the number of encoding layers and increasing a bit rate, it is possible to increase the signal bandwidth and improve the quality of a reproduced speech signal, and it is thus possible to decode a speech signal with narrow signal bandwidth in an error-free state and reproduce the signal as speech even without the enhancement layer encoded information.

Patent Document 1: Japanese Patent Application Laid-Open No. HEI11-30997

DISCLOSURE OF INVENTION

Problems to be Solved by the Invention

However, in the technique as described in Patent Document 1, the core layer encoded information is generated with the CELP scheme using the adaptive codebook, and therefore it cannot be said that the technique is very robust against a loss of the core layer encoded information.

When the adaptive codebook is not used in the CELP scheme, error propagation is avoided since encoding of the speech signal becomes independent from a memory in the encoder, and therefore the error robustness of the CELP scheme is improved. However, when the adaptive codebook is not used in the CELP scheme, a speech signal is quantized by only a fixed codebook, and the quality of reproduced speech generally deteriorates. Further, in order to obtain high quality of reproduced speech using only the fixed codebook, the fixed codebook requires a large number of bits, and further, the encoded speech data requires a high bit rate.

Accordingly, it is therefore an object of the present invention to provide a speech encoding apparatus and the like enabling improvement in robustness against frame loss error without increasing the number of bits of the fixed codebook.

Means for Solving the Problem

A speech encoding apparatus according to the present invention adopts a configuration having: a low-frequency-band component encoding section that encodes a low-frequency-band component having band at least less than a predetermined frequency in a speech signal without using inter-frame prediction and generates low-frequency-band component encoded information; and a high-frequency-band component encoding section that encodes a high-frequency-band component having band exceeding at least the predetermined frequency in the speech signal using inter-frame prediction and generates high-frequency-band component encoded information.

Advantageous Effect of the Invention

According to the present invention, a low-frequency-band component (for example, a low-frequency component less than 500 Hz) of a speech signal which is significant in auditory perception is encoded with the encoding scheme independent from a memory—a scheme without using inter-frame prediction—, for example, a waveform encoding scheme or an encoding scheme in the frequency domain, and a high-frequency-band component in the speech signal is encoded with the CELP scheme using the adaptive codebook and fixed codebook. Therefore, in the low-frequency-band component of the speech signal, error propagation is avoided, and it is made possible to perform concealing processing through interpolation using correct frames prior and subsequent to a lost frame. Therefore, the error robustness is improved in the low-frequency-band component. As a result, according to the present invention, it is possible to reliably improve the quality of speech reproduced by a communication apparatus provided with the speech decoding apparatus.

Further, according to the present invention, since the encoding scheme such as waveform encoding and the like without using inter-frame prediction is applied to the low-frequency-band component of the speech signal, it is possible to suppress a data amount of speech data generated through encoding of the speech signal to a required minimum amount.

Furthermore, according to the present invention, frequency band of the low-frequency-band component of the speech signal is always set so as to include a fundamental frequency (pitch) of speech, so that it is possible to calculate pitch lag information of the adaptive codebook in the high-frequency-band component encoding section using a low-frequency-band component of the excitation signal decoded from the low-frequency-band component encoded information. By this feature, according to the present invention, even when the high-frequency-band component encoding section neither encodes nor transmits the pitch lag information as the high-frequency-band component encoded information, the high-frequency-band component encoding section is capable of encoding the high-frequency-band component of the speech signal using the adaptive codebook. Moreover, according to the present invention, when the high-frequency-band component encoding section encodes the pitch lag information as the high-frequency-band component encoded information to transmit, the high-frequency-band component encoding section is capable of efficiently quantizing the pitch lag information with a small number of bits by utilizing the pitch lag information calculated from a decoded signal of the low-frequency-band component encoded information.

BEST MODE FOR CARRYING OUT THE INVENTION

One embodiment of the present invention will be described in detail below with reference to the accompanying drawings as appropriate.

Figure 1:
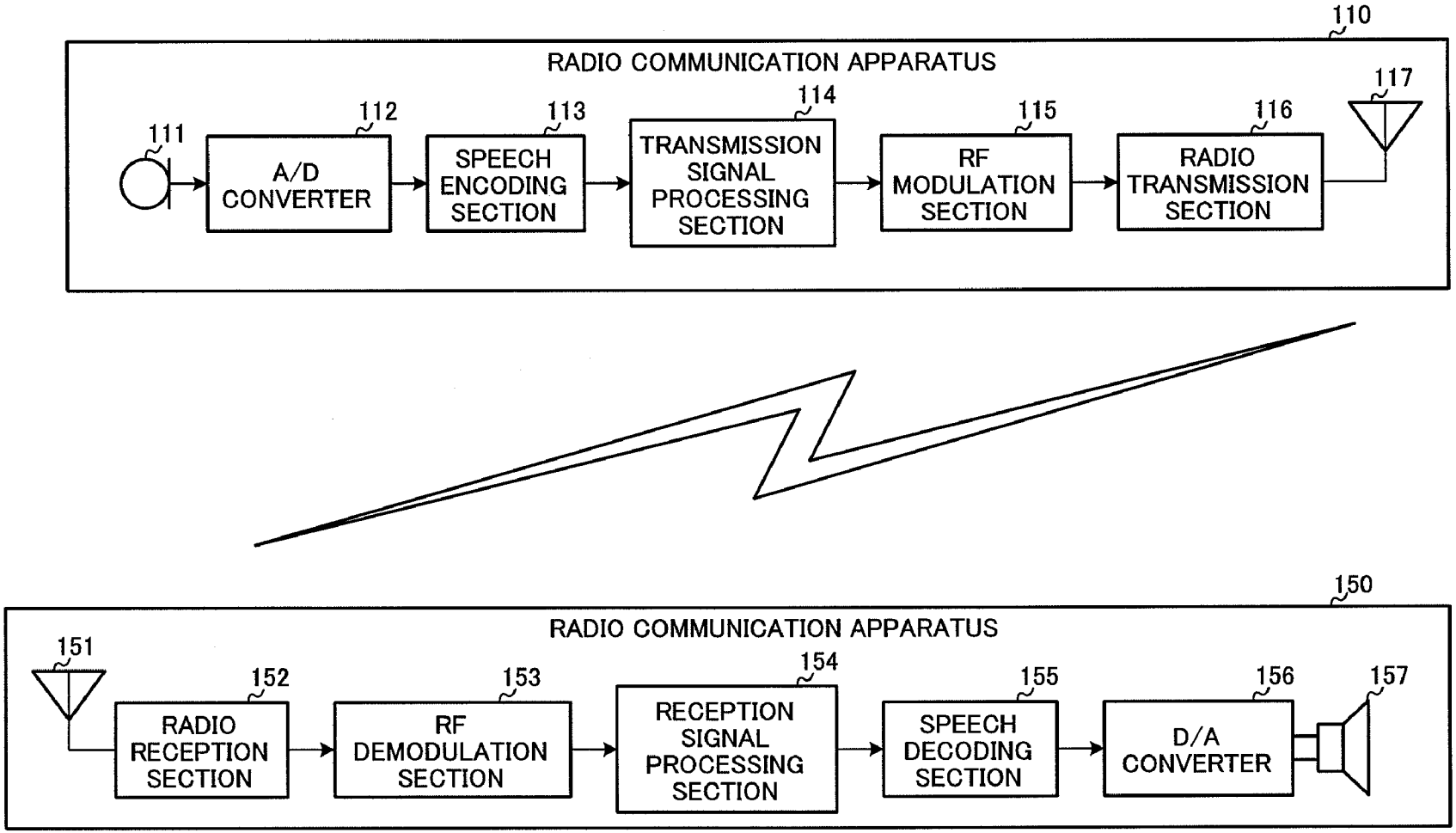
FIG. 1 is a block diagram showing a configuration of a speech signal transmission system according to one embodiment of the present invention.

FIG. 1 is a block diagram showing a configuration of a speech signal transmission system including radio communication apparatus 110 provided with a speech encoding apparatus according to one embodiment of the present invention, and radio communication apparatus 150 provided with a speech decoding apparatus according to this embodiment. In addition, radio communication apparatuses 110 and 150 are radio communication apparatuses in a mobile communication system of mobile telephone and the like, and mutually transmit and receive radio signals via a base station apparatus not shown in the figure.

Radio communication apparatus 110 has speech input section 111, analog/digital (A/D) converter 112, speech encoding section 113, transmission signal processing section 114, radio frequency (RF) modulation section 115, radio transmission section 116 and antenna element 117.

Speech input section 111 is made up of a microphone and the like, transforms speech into an analog speech signal that is an electric signal, and inputs the generated speech signal to A/D converter 112.

A/D converter 112 converts the analog speech signal inputted from speech input section 111 into a digital speech signal, and inputs the digital speech signal to speech encoding section 113.

Speech encoding section 113 encodes the digital speech signal inputted from A/D converter 112 to generate a speech encoded bit sequence, and inputs the generated speech encoded bit sequence to transmission signal processing section 114. In addition, the operation and function of speech encoding section 113 will be described in detail later.

Transmission signal processing section 114 performs channel encoding processing, packetizing processing, transmission buffer processing and the like on the speech encoded bit sequence inputted from speech encoding section 113, and inputs the processed speech encoded bit sequence to RF modulation section 115.

RF modulation section 115 modulates the speech encoded bit sequence inputted from transmission signal processing section 114 with a predetermined scheme, and inputs the modulated speech encoded signal to radio transmission section 116.

Radio transmission section 116 has a frequency converter, low-noise amplifier and the like, transforms the speech encoded signal inputted from RF modulation section 115 into a carrier with a predetermined frequency, and radio transmits the carrier with predetermined power via antenna element 117.

In addition, in radio communication apparatus 110, various kinds of signal processing subsequent to A/D conversion are executed on the digital speech signal generated in A/D converter 112 on a basis of a frame of several tens of milliseconds. Further, when a network (not shown) which is a component of the speech signal transmission system is a packet network, transmission signal processing section 114 generates a packet from the speech encoded bit sequence corresponding to a frame or several frames. When the network is a line switching network, transmission signal processing section 114 does not need to perform packetizing processing and transmission buffer processing.

Meanwhile, radio communication apparatus 150 is provided with antenna element 151, radio reception section 152, RF demodulation section 153, reception signal processing section 154, speech decoding section 155, digital/analog (D/A) converter 156 and speech reproducing section 157.

Radio reception section 152 has a band-pass filter, low-noise amplifier and the like, generates a reception speech signal which is an analog electric signal from the radio signal received in antenna element 151, and inputs the generated reception speech signal to RF demodulation section 153.

RF demodulation section 153 demodulates the reception speech signal inputted from radio reception section 152 with a demodulation scheme corresponding to the modulation scheme in RF modulation section 115 to generate a reception speech encoded signal, and inputs the generated reception speech encoded signal to reception signal processing section 154.

Reception signal processing section 154 performs jitter absorption buffering processing, depacketizing processing, channel decoding processing and the like on the reception speech encoded signal inputted from RF demodulation section 153 to generate a reception speech encoded bit sequence, and inputs the generated reception speech encoded bit sequence to speech decoding section 155.

Speech decoding section 155 performs decoding processing on the reception speech encoded bit sequence inputted from reception signal processing section 154 to generate a digital decoded speech signal, and inputs the generated digital decoded speech signal to D/A converter 156.

D/A converter 156 converts the digital decoded speech signal inputted from speech decoding section 155 into an analog decoded speech signal, and inputs the converted analog decoded speech signal to speech reproducing section 157.

Speech reproducing section 157 transforms the analog decoded speech signal inputted from D/A converter 156 into vibration of air to output as a sound wave so as to be heard by human ear.

Figure 2:
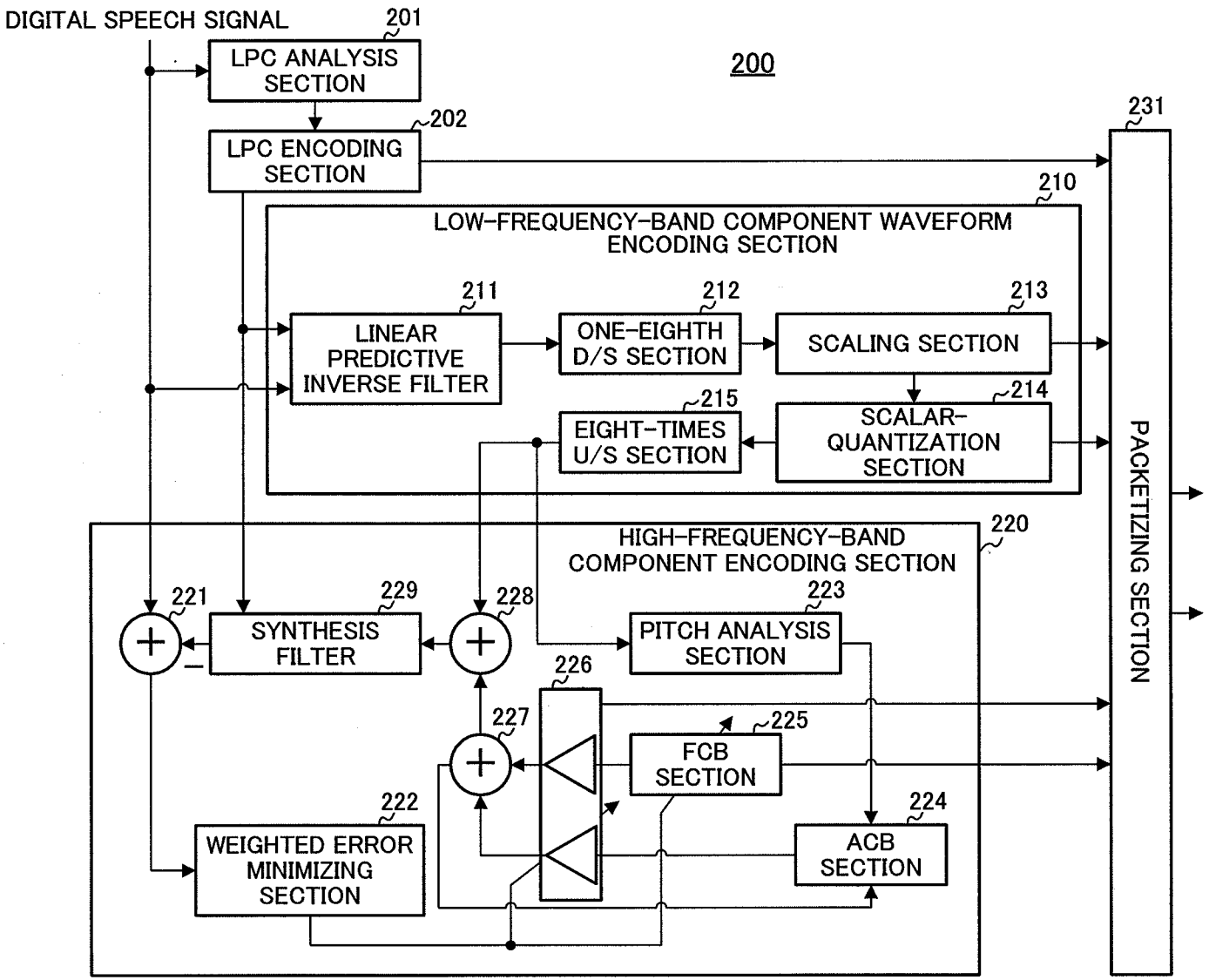
FIG. 2 is a block diagram showing a configuration of a speech encoding apparatus according to one embodiment of the present invention.

FIG. 2 is a block diagram showing a configuration of speech encoding apparatus 200 according to this embodiment. Speech encoding apparatus 200 is provided with linear predictive coding (LPC) analysis section 201, LPC encoding section 202, low-frequency-band component waveform encoding section 210, high-frequency-band component encoding section 220 and packetizing section 231.

In addition, LPC analysis section 201, LPC encoding section 202, low-frequency-band component waveform encoding section 210 and high-frequency-band component encoding section 220 in speech encoding apparatus 200 configure speech encoding section 113 in radio communication apparatus 110, and packetizing section 231 is a part of transmission signal processing section 114 in radio communication apparatus 110.

Low-frequency-band component waveform encoding section 210 is provided with linear predictive inverse filter 211, one-eighth down-sampling (DS) section 212, scaling section 213, scalar-quantization section 214 and eight-times up-sampling (US) section 215. High-frequency-band component encoding section 220 is provided with adders 221, 227 and 228, weighted error minimizing section 222, pitch analysis section 223, adaptive codebook (ACB) section 224, fixed codebook (FCB) section 225, gain quantizing section 226 and synthesis filter 229.

LPC analysis section 201 performs linear predictive analysis on the digital speech signal inputted from A/D converter 112, and inputs LPC parameters (linear predictive parameters or LPC coefficients) that are results of analysis to LPC encoding section 202.

LPC encoding section 202 encodes the LPC parameters inputted from LPC analysis section 201 to generate quantized LPC, and inputs encoded information of the quantized LPC to packetizing section 231, and inputs the generated quantized LPC to linear predictive inverse filter 211 and synthesis filter 229. In addition, for example, LPC encoding section 202 once converts the LPC parameters into LSP parameters and the like, performs vector-quantization and the like on the converted LSP parameters, and thereby encodes the LPC parameters.

Based on the quantized LPC inputted from LPC encoding section 202, low-frequency-band component waveform encoding section 210 calculates a linear predictive residual signal of the digital speech signal inputted from A/D converter 112, performs down-sampling processing on the calculation result, thereby extracts a low-frequency-band component of band less than a predetermined frequency in the speech signal, and performs waveform encoding on the extracted low-frequency-band component to generate low-frequency-band component encoded information. Low-frequency-band component waveform encoding section 210 inputs the low-frequency-band component encoded information to packetizing section 231, and inputs a quantized low-frequency-band component waveform encoded signal (excitation waveform) generated through waveform encoding to high-frequency-band component encoding section 220. The low-frequency-band component waveform encoded information generated by low-frequency-band component waveform encoding section 210 constitutes the core layer encoded information in the encoded information through scalable encoding. In addition, it is preferable that the upper-limit frequency of the low-frequency-band component is in the range of 500 Hz to 1 kHz.

Linear predictive inverse filter 211 is a digital filter that performs signal processing expressed by equation (1) on the digital speech signal using the quantized LPC inputted from LPC encoding section 202, calculates a linear predictive residual signal through the signal processing expressed by equation (1), and inputs the calculated linear predictive residual signal to one-eighth DS section 212. In addition, in equation (1), X(n) is an input signal sequence of the linear predictive inverse filter, Y(n) is an output signal sequence of the linear predictive inverse filter, and $\alpha(i)$ is an i-th quantized LPC.

$$Y(n) = X(n) + \sum_{i=1}^{M} (\alpha(i) \times X(n-i)) \tag{1}$$

One-eighth DS section 212 performs one-eighth down sampling on the linear predictive residual signal inputted from linear predictive inverse filter 211, and inputs a sampling signal with a sampling frequency of 1 kHz to scaling section 213. In addition, in this embodiment, it is assumed that a delay does not occur in one-eighth DS section 212 or eight-times US section 215 described later by using a pre-read signal (inserting actually pre-read data or performing zero filling) corresponding to a delay time generated due to down-sampling. When a delay occurs in one-eighth DS section 212 or eight-times US section 215, an output excitation vector is delayed in adder 227 described later so as to obtain good matching in adder 228 described later.

Scaling section 213 performs scalar-quantization (for example, 8 bits μ-law/A-law PCM: Pulse Code Modulation) on a sample having a maximum amplitude in a frame in the sampling signal (linear predictive residual signal) inputted from one-eighth DS section 212, with a predetermined number of bits, and inputs encoded information of the scalar-quantization, i.e. scaling coefficient encoded information, to packetizing section 231. Further, scaling section 213 performs scaling (normalization) on the linear predictive residual signal corresponding to a single frame with a scalar-quantized maximum amplitude value, and inputs the scaled linear predictive residual signal to scalar-quantization section 214.

Scalar-quantization section 214 performs scalar-quantization on the linear predictive residual signal inputted from scaling section 213, and inputs the encoded information of the scalar-quantization, i.e. low-frequency-band component encoded information of the normalized excitation signal, to packetizing section 231, and inputs the scalar-quantized linear predictive residual signal to eight-times US section 215. In addition, scalar-quantization section 214 applies a PCM or DPCM (Differential Pulse-Code Modulation) scheme, for example, in the scalar-quantization.

Eight-times US section 215 performs eight-times up-sampling on the scalar-quantized linear predictive residual signal inputted from scalar-quantization section 214 to generate a signal with a sampling frequency of 8 kHz, and inputs the sampling signal (linear predictive residual signal) to pitch analysis section 223 and adder 228.

High-frequency-band component encoding section 220 performs CELP-encoding on a component other than the low-frequency-band component, i.e. high-frequency-band component made up of band exceeding the frequency in the speech signal, of the speech signal encoded in low-frequency-band component waveform encoding section 210, and generates high-frequency-band component encoded information. Then, high-frequency-band component encoding section 220 inputs the generated high-frequency-band component encoded information to packetizing section 231. The high-frequency-band component encoded information generated by high-frequency-band component encoding section 220 constitutes the enhancement layer encoded information in the encoded information through scalable encoding.

Adder 221 subtracts a synthesis signal inputted from synthesis filter 229 described later from the digital speech signal inputted from A/D converter 112, thereby calculates an error signal, and inputs the calculated error signal to weighted error minimizing section 222. In addition, the error signal calculated in adder 221 corresponds to encoding distortion.

Weighted error minimizing section 222 determines encoding parameters in FCB section 225 and gain quantizing section 226 so as to minimize the error signal inputted from adder 221 using a perceptual (auditory perception) weighting filter, and indicates the determined encoding parameters to FCB section 225 and gain quantizing section 226. Further, weighted error minimizing section 222 calculates filter coefficients of the perceptual weighting filter based on the LPC parameters analyzed in LPC analysis section 201.

Pitch analysis section 223 calculates a pitch lag (pitch period) of the scalar-quantized linear predictive residual signal (excitation waveform) subjected to up-sampling and inputted from eight-times US section 215, and inputs the calculated pitch lag to ACB section 224. In other words, pitch analysis section 223 searches for a current pitch lag using the linear predictive residual signal (excitation waveform) of the low-frequency-band component which has been currently and previously scalar-quantized. In addition, pitch analysis section 223 is capable of calculating a pitch lag, for example, by a typical method using a normalized auto-correlation function. Incidentally, a high pitch of female voice is about 400 Hz.

ACB section 224 stores output excitation vectors previously generated and inputted from adder 227 described later in a built-in buffer, generates an adaptive code vector based on the pitch lag inputted from pitch analysis section 223, and inputs the generated adaptive code vector to gain quantizing section 226.

FCB section 225 inputs an excitation vector corresponding to the encoding parameters indicated from weighted error minimizing section 222 to gain quantizing section 226 as a fixed code vector. FCB section 225 further inputs a code indicating the fixed code vector to packetizing section 231.

Gain quantizing section 226 generates gain corresponding to the encoding parameters indicated from weighted error minimizing section 222, more specifically, gain corresponding to the adaptive code vector from ACB section 224 and the fixed code vector from FCB section 225, that is, adaptive codebook gain and fixed codebook gain. Then, gain quantizing section 226 multiplies the adaptive code vector inputted from ACB section 224 by the generated adaptive codebook gain, similarly multiplies the fixed code vector inputted from FCB section 225 by the generated fixed codebook gain, and inputs the multiplication results to adder 227. Further, gain quantizing section 226 inputs gain parameters (encoded information) indicated from weighted error minimizing section 222 to packetizing section 231. In addition, the adaptive codebook gain and fixed codebook gain may be separately scalar-quantized, or vector-quantized as two-dimensional vectors. In addition, when encoding is performed using inter-frame or inter-subframe prediction of a digital speech signal, encoding efficiency is improved.

Adder 227 adds the adaptive code vector multiplied by the adaptive codebook gain and the fixed code vector multiplied by the fixed codebook gain inputted from gain quantizing section 226, generates an output excitation vector of high-frequency-band component encoding section 220, and inputs the generated output excitation vector to adder 228. Further, after an optimal output excitation vector is determined, adder 227 reports the optimal output excitation vector to ACB section 224 for feedback and updates the content of the adaptive codebook.

Adder 228 adds the linear predictive residual signal generated in low-frequency-band component waveform encoding section 210 and the output excitation vector generated in high-frequency-band component encoding section 220, and inputs the added output excitation vector to synthesis filter 229.

Using the quantized LPC inputted from LPC encoding section 202, synthesis filter 229 performs synthesis by the LPC synthesis filter using the output excitation vector inputted from adder 228 as an excitation vector, and inputs the synthesized signal to adder 221.

Packetizing section 231 classifies the encoded information of the quantized LPC inputted from LPC encoding section 202, and scaling coefficient encoded information and low-frequency-band component encoded information of the normalized excitation signal inputted from low-frequency-band component waveform encoding section 210 as low-frequency-band component encoded information. And packetizing section 231 also classifies the fixed code vector encoded information and gain parameter encoded information inputted from high-frequency-band component encoding section 220 as high-frequency-band component encoded information, and individually packetizes the low-frequency-band component encoded information and the high-frequency-band component encoded information to radio transmit to a transmission path. Particularly, packetizing section 231 radio transmits the packet including the low-frequency-band component encoded information to the transmission path subjected to QoS (Quality of Service) control or the like. In addition, instead of radio transmitting the low-frequency-band component encoded information to the transmission path subjected to QoS control or the like, packetizing section 231 may apply channel encoding with strong error protection and radio transmit the information to a transmission path.

Figure 3:
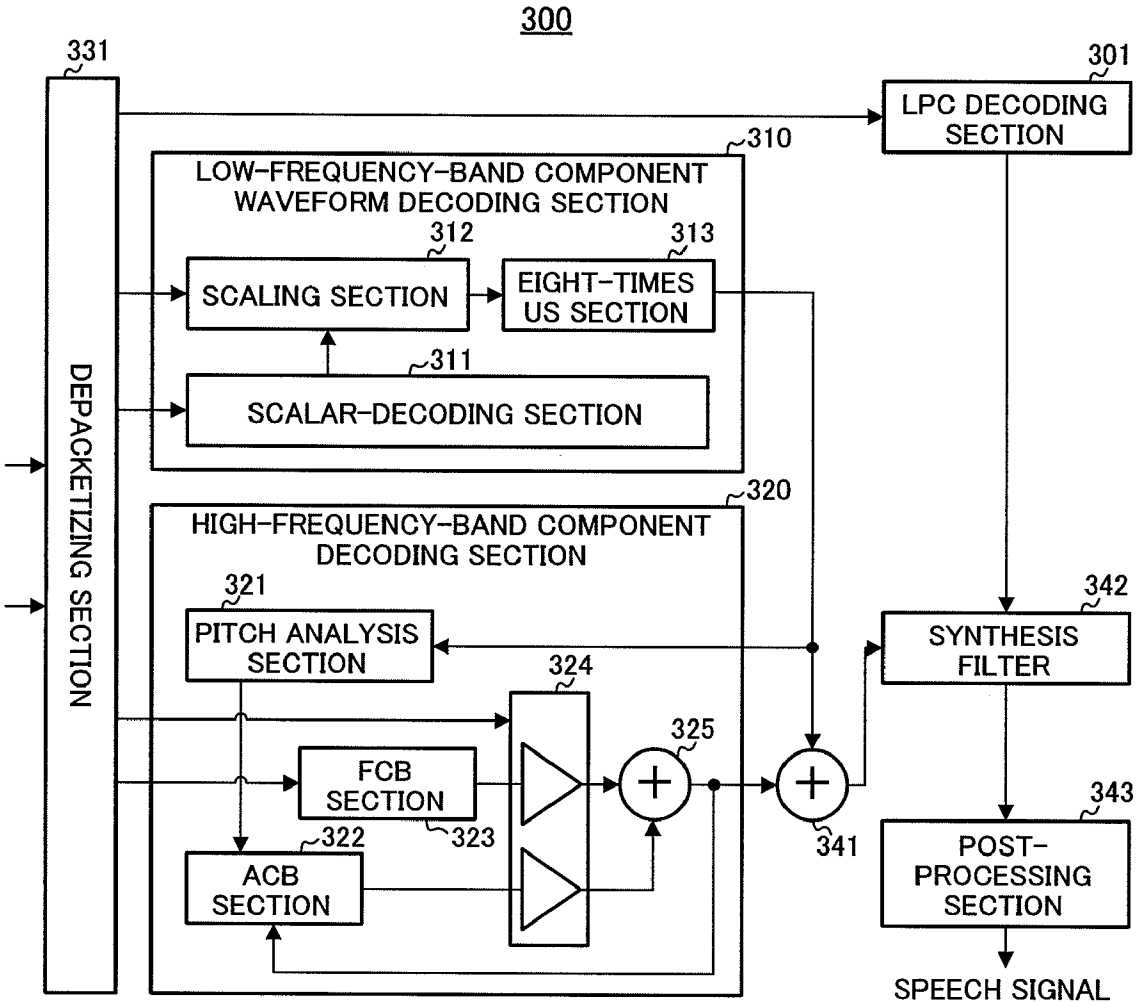
FIG. 3 is a block diagram showing a configuration of a speech decoding apparatus according to one embodiment of the present invention.

FIG. 3 is a block diagram showing a configuration of speech decoding apparatus 300 according to this embodiment. Speech decoding apparatus 300 is provided with LPC decoding section 301, low-frequency-band component waveform decoding section 310, high-frequency-band component decoding section 320, depacketizing section 331, adder 341, synthesis filter 342 and post-processing section 343. In addition, depacketizing section 331 in speech decoding apparatus 300 is a part of reception signal processing section 154 in radio communication apparatus 150. LPC decoding section 301, low-frequency-band component waveform decoding section 310, high-frequency-band component decoding section 320, adder 341 and synthesis filter 342 configure a part of speech decoding section 155, and post-processing section 343 configures a part of speech decoding section 155 and a part of D/A converter 156.

Low-frequency-band component waveform decoding section 310 is provided with scalar-decoding section 311, scaling section 312 and eight-times US section 313. High-frequency-band component decoding section 320 is provided with pitch analysis section 321, ACB section 322, FCB section 323, gain decoding section 324 and adder 325.

Depacketizing section 331 receives a packet including the low-frequency-band component encoded information (quantized LPC encoded information, scaling coefficient encoded information and low-frequency-band component encoded information of the normalized excitation signal) and another packet including the high-frequency-band component encoded information (fixed code vector encoded information and gain parameter encoded information), and inputs the quantized LPC encoded information to LPC decoding section 301, the scaling coefficient encoded information and low-frequency-band component encoded information of the normalized excitation signal to low-frequency-band component waveform decoding section 310, and the fixed code vector encoded information and gain parameter encoded information to high-frequency-band component decoding section 320. In addition, in this embodiment, since the packet including the low-frequency-band component encoded information is received via the channel in which transmission path error or loss is maintained to be rare by QoS control or the like, depacketizing section 331 has two input lines. When a packet loss is detected, depacketizing section 331 reports the packet loss to a section that decodes the encoded information that would be included in the lost packet, that is, one of LPC decoding section 301, low-frequency-band component waveform decoding section 310 and high-frequency-band component decoding section 320. Then, the section which receives the report of the packet loss from depacketizing section 331 performs decoding processing through concealing processing.

LPC decoding section 301 decodes the encoded information of quantized LPC inputted from depacketizing section 331, and inputs the decoded LPC to synthesis filter 342.

Scalar-decoding section 311 decodes the low-frequency-band component encoded information of the normalized excitation signal inputted from depacketizing section 331, and inputs the decoded low-frequency-band component of the excitation signal to scaling section 312.

Scaling section 312 decodes the scaling coefficients from the scaling coefficient encoded information inputted from depacketizing section 331, multiplies the low-frequency-band component of the normalized excitation signal inputted from scalar-decoding section 311 by the decoded scaling coefficients, generates a decoded excitation signal (linear predictive residual signal) of the low-frequency-band component of the speech signal, and inputs the generated decoded excitation signal to eight-times US section 313.

Eight-times US section 313 performs eight-times up-sampling on the decoded excitation signal inputted from scaling section 312, obtains a sampling signal with a sampling frequency of 8 kHz, and inputs the sampling signal to pitch analysis section 321 and adder 341.

Pitch analysis section 321 calculates the pitch lag of the sampling signal inputted from eight-times US section 313, and inputs the calculated pitch lag to ACB section 322. Pitch analysis section 321 is capable of calculating a pitch lag, for example, by a typical method using a normalized auto-correlation function.

ACB section 322 is a buffer of the decoded excitation signal, generates an adaptive code vector based on the pitch lag inputted from pitch analysis section 321, and inputs the generated adaptive code vector to gain decoding section 324.

FCB section 323 generates a fixed code vector based on the high-frequency-band component encoded information (fixed code vector encoded information) inputted from depacketizing section 331, and inputs the generated fixed code vector to gain decoding section 324.

Gain decoding section 324 decodes the adaptive codebook gain and fixed codebook gain using the high-frequency-band component encoded information (gain parameter encoded information) inputted from depacketizing section 331, multiplies the adaptive code vector inputted from ACB section 322 by the decoded adaptive codebook gain, similarly multiplies the fixed code vector inputted from FCB section 323 by the decoded fixed codebook gain, and inputs the multiplication results to adder 325.

Adder 325 adds two multiplication results inputted from gain decoding section 324, and inputs the addition result to adder 341 as an output excitation vector of high-frequency-band component decoding section 320. Further, adder 325 reports the output excitation vector to ACB section 322 for feedback and updates the content of the adaptive codebook.

Adder 341 adds the sampling signal inputted from low-frequency-band component waveform decoding section 310 and the output excitation vector inputted from high-frequency-band component decoding section 320, and inputs the addition result to synthesis filter 342.

Synthesis filter 342 is a linear predictive filter configured using LPC inputted from LPC decoding section 301, excites the linear predictive filter using the addition result inputted from adder 341, performs speech synthesis, and inputs the synthesized speech signal to post-processing section 343.

Post-processing section 343 performs processing for improving a subjective quality, for example, post-filtering, background noise suppression processing or background noise subjective quality improvement processing on the signal generated by synthesis filter 342, and generates a final speech signal. Accordingly, the speech signal generating section according to the present invention is configured with adder 341, synthesis filter 342 and post-processing 343.

The operation of speech encoding apparatus 200 and speech decoding apparatus 300 according to this embodiment will be described below with reference to FIGS. 4 and 5.

Figure 4:
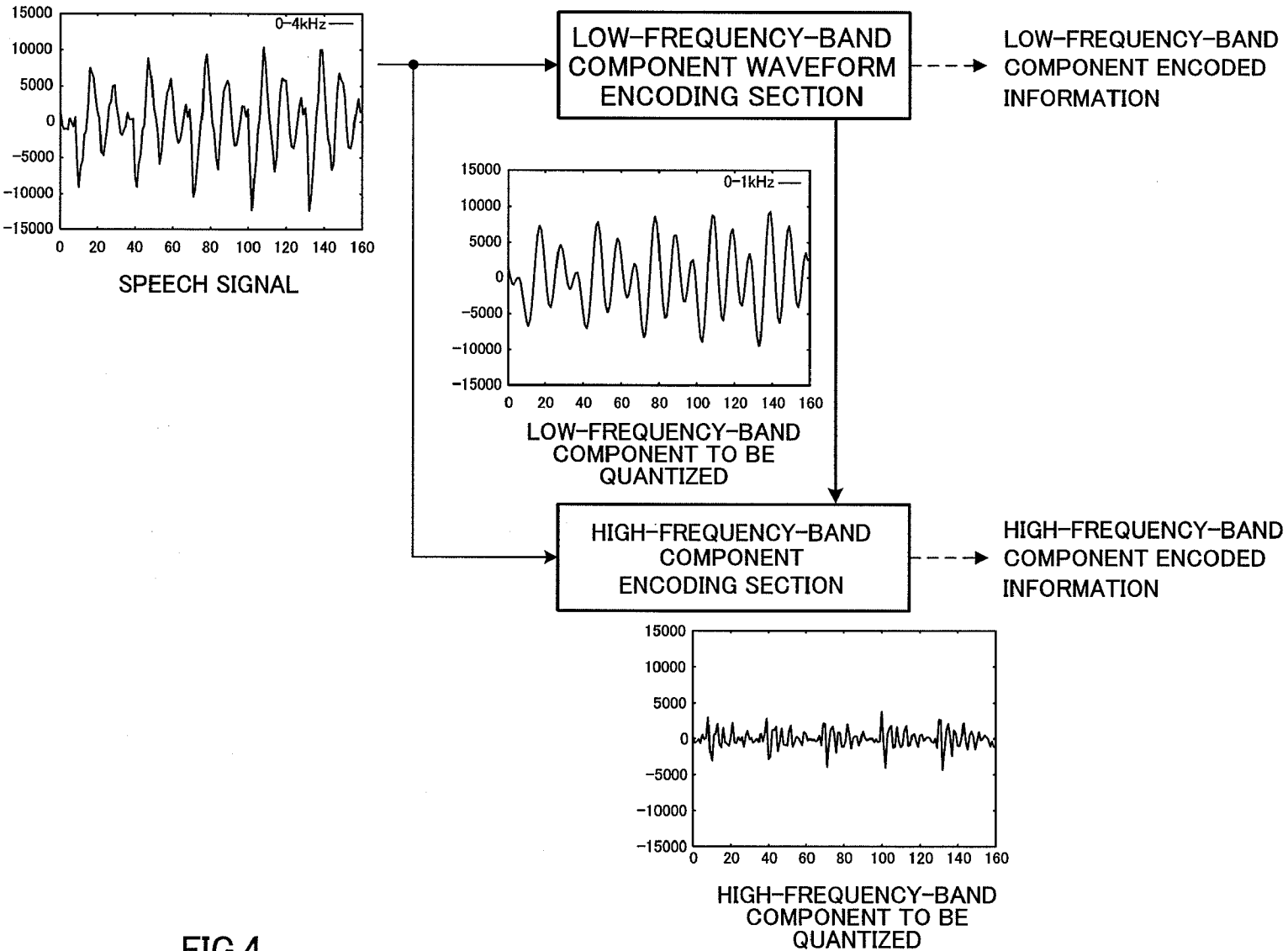
FIG. 4 shows the operation of the speech encoding apparatus according to one embodiment of the present invention.

FIG. 4 shows an aspect where the low-frequency-band component encoded information and high-frequency-band component encoded information are generated from a speech signal.

Low-frequency-band component waveform encoding section 210 extracts a low-frequency-band component by sampling the speech signal and the like, performs waveform encoding on the extracted low-frequency-band component, and generates the low-frequency-band component encoded information. Then, speech encoding apparatus 200 transforms the generated low-frequency-band component encoded information to a bitstream, performs packetization, modulation and the like, and radio transmits the information. Further, low-frequency-band component waveform encoding section 210 generates and quantizes a linear predictive residual signal (excitation waveform) of the low-frequency-band component of the speech signal, and inputs the quantized linear predictive residual signal to high-frequency-band component encoding section 220.

High-frequency-band component encoding section 220 generates the high-frequency-band component encoded information that minimizes an error between the synthesized signal generated based on the quantized linear predictive residual signal and the input speech signal. Then, speech encoding apparatus 200 transforms the generated high-frequency-band component encoded information to a bitstream, performs packetization, modulation and the like, and radio transmits the information.

Figure 5:
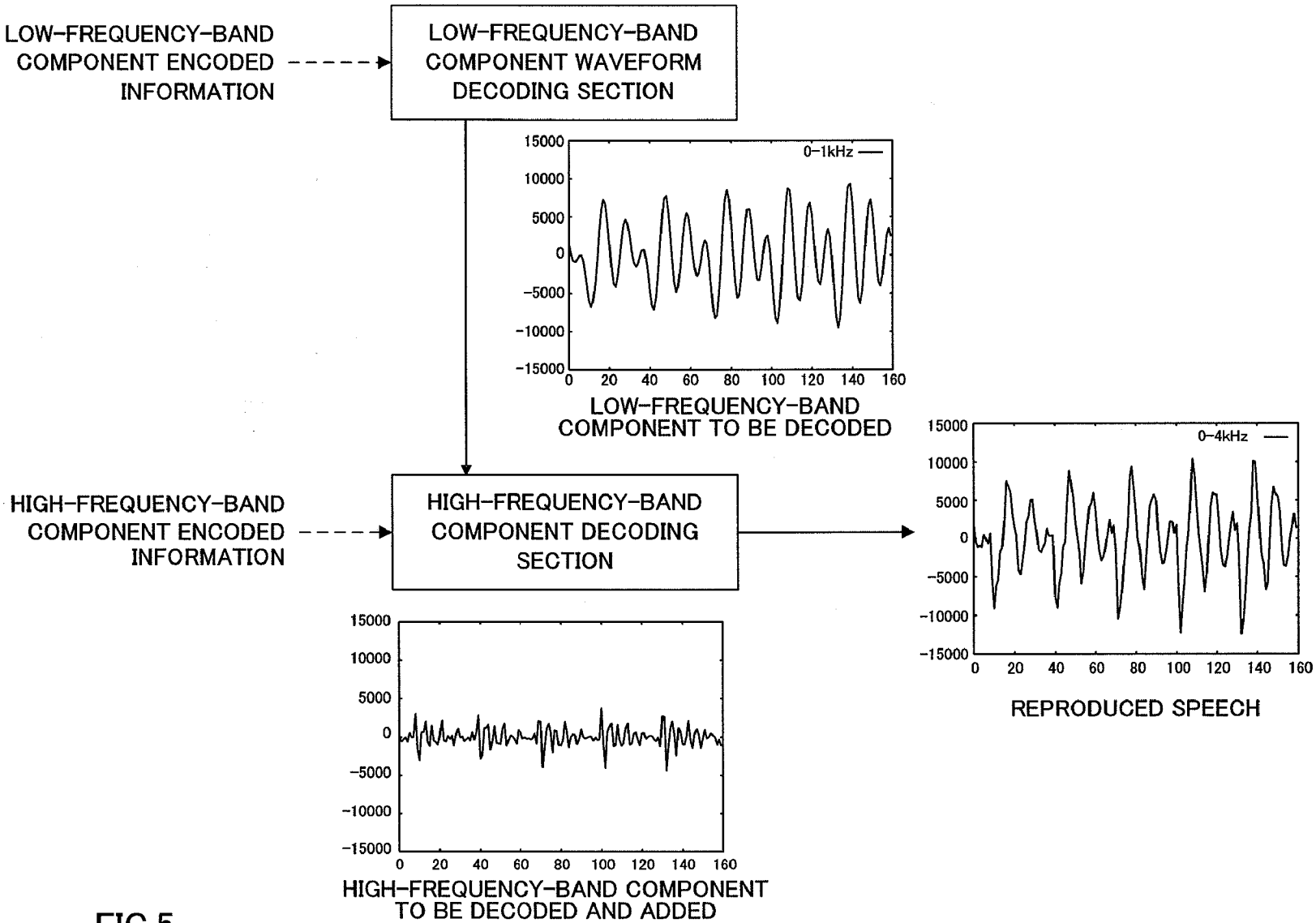
FIG. 5 shows the operation of the speech decoding apparatus according to one embodiment of the present invention.

FIG. 5 shows an aspect where the speech signal is reproduced from the low-frequency-band component encoded information and high-frequency-band component encoded information received via a transmission path. Low-frequency-band component waveform decoding section 310 decodes the low-frequency-band component encoded information and generates a low-frequency-band component of the speech signal, and inputs the generated low-frequency-band component to high-frequency-band component decoding section 320. High-frequency-band component decoding section 320 decodes the enhancement layer encoded information and generates a high-frequency-band component of the speech signal, and generates the speech signal for reproduction by adding the generated high-frequency-band component and the low-frequency-band component inputted from low-frequency-band component waveform decoding section 310.

Thus, according to this embodiment, the low-frequency-band component (for example, a low-frequency component less than 500 Hz) of the speech signal which is significant in auditory perception is encoded with the waveform encoding scheme without using inter-frame prediction, and the other high-frequency-band component is encoded with the encoding scheme using inter-frame prediction, that is, the CELP scheme using ACB section 224 and FCB section 225. Therefore, in the low-frequency-band component of the speech signal, error propagation is avoided, and it is made possible to perform concealing processing based on interpolation using correct frames prior and subsequent to a lost frame, so that the error robustness is thus improved in the low-frequency-band component. As a result, according to this embodiment, it is possible to reliably improve the quality of speech reproduced by radio communication apparatus 150 provided with speech decoding apparatus 300. Incidentally, herein, inter-frame prediction is to predict the information of a current or future frame from the information of a past frame.

Further, according to this embodiment, since the waveform encoding scheme is applied to the low-frequency-band component of the speech signal, it is possible to suppress a data amount of speech data generated through encoding of the speech signal to a required minimum amount.

Furthermore, according to this embodiment, frequency band of the low-frequency-band component of the speech signal is always set so as to include a fundamental frequency (pitch) of speech, so that it is possible to calculate the pitch lag information of the adaptive codebook in high-frequency-band component encoding section 220 using the low-frequency-band component of an excitation signal decoded from the low-frequency-band component encoded information. By this feature, according to this embodiment, even when high-frequency-band component encoding section 220 does not encode the pitch lag information as the high-frequency-band component encoded information, high-frequency-band component encoding section 220 is capable of encoding the speech signal using the adaptive codebook. Moreover, according to this embodiment, when high-frequency-band component encoding section 220 encodes the pitch lag information as the high-frequency-band component encoded information, high-frequency-band component encoding section 220 uses the pitch lag information calculated from the decoded signal of the low-frequency-band component encoded information, and thereby is capable of efficiently quantizing the pitch lag information with a small number of bits.

Still further, since the low-frequency-band component encoded information and high-frequency-band component encoded information are radio transmitted in different packets, by performing priority control to discard the packet including the high-frequency-band component encoded information earlier than the packet including the low-frequency-band component encoded information, it is possible to further improve error robustness.

In addition, this embodiment may be applied and/or modified as described below. In this embodiment, the case has been described where low-frequency-band component waveform encoding section 210 uses the waveform encoding scheme as an encoding scheme without using inter-frame prediction, and high-frequency-band component encoding section 220 uses the CELP scheme using ACB section 224 and FCB section 225 as an encoding scheme using inter-frame prediction. However, the present invention is not limited to this, and, for example, low-frequency-band component waveform encoding section 210 may use an encoding scheme in the frequency domain as an encoding scheme without using inter-frame prediction, and high-frequency-band component encoding section 220 may use a vocoder scheme as an encoding scheme using inter-frame prediction.

In this embodiment, the case has been described as an example where the upper-limit frequency of the low-frequency-band component is in the range of about 500 Hz to 1 kHz, but the present invention is not limited to this, and the upper-limit frequency of the low-frequency-band component may be set at a value higher than 1 kHz according to the entire frequency bandwidth subjected to encoding, channel speed of the transmission path and the like.

Further, in this embodiment, the case has been described where the upper-limit frequency of the low-frequency-band component in low-frequency-band component waveform encoding section 210 is in the range of about 500 Hz to 1 kHz, and down-sampling in one-eighth DS section 212 is one-eighth, but the present invention is not limited to this, and, for example, the rate of down-sampling in one-eighth DS section 212 may be set so that the upper-limit frequency of the low-frequency-band component encoded in low-frequency-band component waveform encoding section 210 becomes a Nyquist frequency. Further, the rate in eight-time US section 215 is the same as in the foregoing.

Furthermore, in this embodiment, the case has been described where the low-frequency-band component encoded information and high-frequency-band component encoded information are transmitted and received in different packets, but the present invention is not limited to this, and, for example, the low-frequency-band component encoded information and high-frequency-band component encoded information may be transmitted and received in the same packet. By this means, although it is not possible to obtain the effect of QoS control through scalable encoding, it is possible to provide an advantage of preventing error propagation of the low-frequency-band component and perform the frame loss concealment processing with high quality.

Still further, in this embodiment, the case has been described where band less than a predetermined frequency in a speech signal is the low-frequency-band component, and band exceeding the predetermined frequency is the high-frequency-band component, but the present invention is not limited to this, and, for example, the low-frequency-band component of the speech signal may have at least band less than the predetermined frequency, and the high-frequency-band component may have at least band exceeding the frequency. In other words, in the present invention, the frequency band of the low-frequency-band component in the speech signal may be overlapped with a part of the frequency band of the high-frequency-band component.

Moreover, in this embodiment, the case has been described where the pitch lag calculated from the excitation waveform generated in low-frequency-band component waveform encoding section 210 is used as is, but the present invention is not limited to this, and, for example, high-frequency-band component encoding section 220 may re-search the adaptive codebook in the vicinity of the pitch lag calculated from the excitation waveform generated in low-frequency-band component waveform encoding section 210, generate error information between the pitch lag obtained through re-search and the pitch lag calculated from the excitation waveform, and also encode the generated error information and radio transmit the information.

Figure 6:
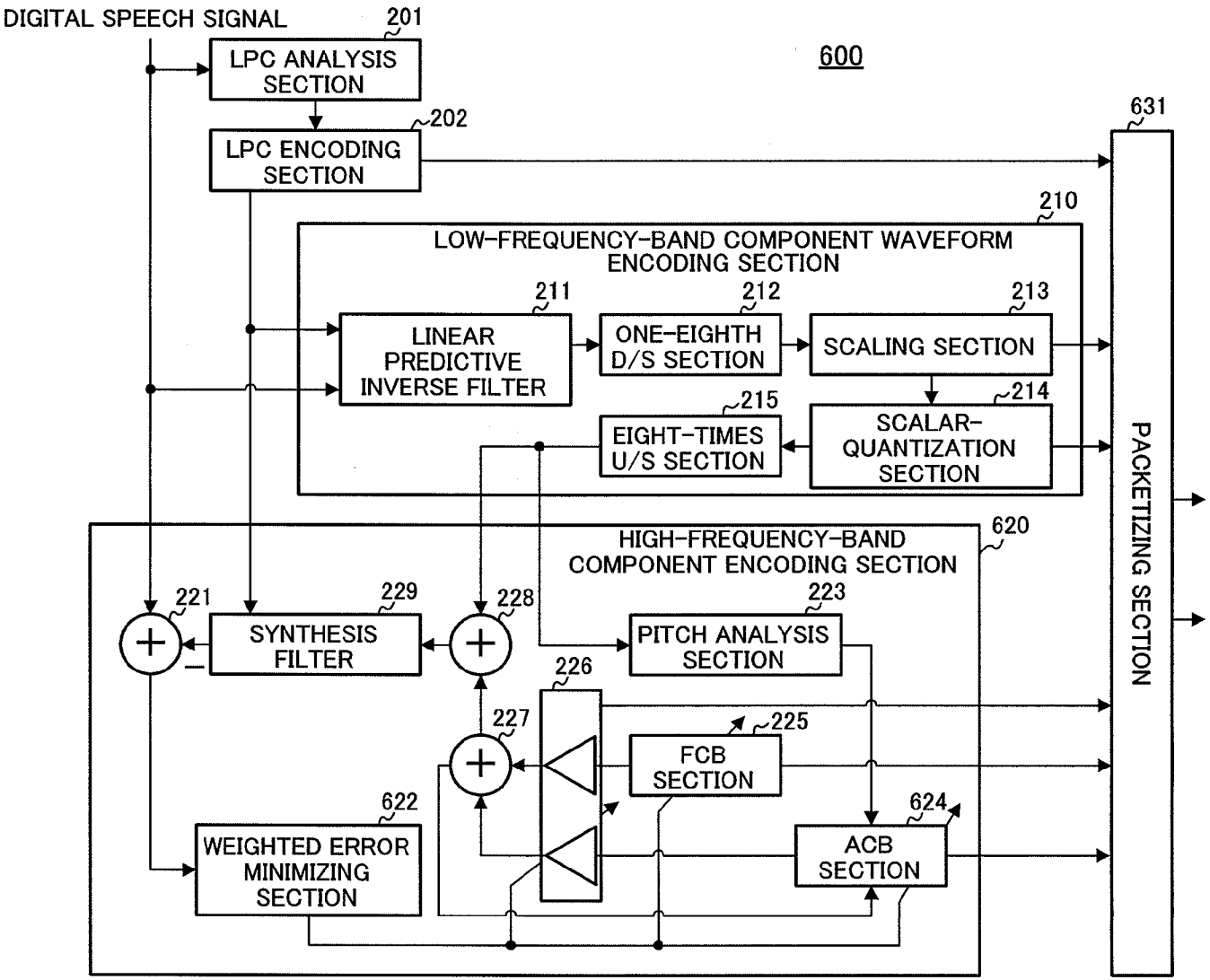
FIG. 6 is a block diagram showing a configuration of a modification example of the speech encoding apparatus.

FIG. 6 is a block diagram showing a configuration of speech encoding apparatus 600 according to this modification example. In FIG. 6, sections that have the same functions as the sections of speech encoding apparatus 200 as shown in FIG. 2 will be assigned the same reference numerals. In FIG. 6, in high-frequency-band component encoding section 620, weighted error minimizing section 622 re-searches ACB section 624, and ACB section 624 generates error information between the pitch lag obtained through the re-search and the pitch lag calculated from the excitation waveform generated in low-frequency-band component waveform encoding section 210, and inputs the generated error information to packetizing section 631. Then, packetizing section 631 packetizes the error information as a part of the high-frequency-band component encoded information and radio transmits the information.

In addition, the fixed codebook used in this embodiment may be referred to as a noise codebook, stochastic codebook or random codebook.

Further, the fixed codebook used in this embodiment may be referred to as a fixed excitation codebook, and the adaptive codebook used in this embodiment may be referred to as an adaptive excitation codebook.

Furthermore, arccosine of LSP used in this embodiment, i.e arccos(L(i)) when LSP is L(i), may be particularly referred to as LSF (Linear Spectral Frequency) to be distinguished from LSP. In the present application, it is assumed that LSF is a form of LSP, and that LSP includes LSF. In other words, LSP may be regarded as LSF, and similarly, LSP may be regarded as ISP (Immittance Spectrum Pairs).

In addition, the case has been described as an example where the present invention is configured with hardware, but the present invention is capable of being implemented by software. For example, by describing the speech encoding method algorithm according to the present invention in a programming language, storing this program in a memory and making an information processing section execute this program, it is possible to implement the same function as the speech encoding apparatus of the present invention.

Furthermore, each function block used to explain the above-described embodiment is typically implemented as an LSI constituted by an integrated circuit. These may be individual chips or may be partially or totally contained on a single chip.

Furthermore, here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2004-252037, filed on Aug. 31, 2004, entire content of which is expressly incorporated by reference herein.

INDUSTRIAL APPLICABILITY

The present invention provides an advantage of improving error resistance without increasing the number of bits in the fixed codebook in CELP type speech encoding, and is useful as a radio communication apparatus and the like in the mobile radio communication system.

The invention claimed is:

1. A speech encoding apparatus, comprising:

a linear prediction analyzer that analyzes an input digital speech signal and outputs linear predictive coefficients;

a linear predictive coefficients quantizer that quantizes the linear predictive coefficients;

a low-frequency-band component encoder that encodes a down-sampled linear-predictive residual signal by a pulse-code-modulation encoder and generates low-frequency-band component encoded information; and a high-frequency-band component encoder that encodes an error signal between a linear-predictive residual signal and an up-sampled signal of a decoded down-sampled linear-predictive residual signal by a code-excited-linear-prediction encoder and generates high-frequency-band component encoded information.

2. The speech encoding apparatus according to claim 1, wherein the high-frequency-band component encoder encodes the error signal using an adaptive codebook and a fixed codebook.

3. A communication apparatus comprising the speech encoding apparatus according to claim 1.

4. The speech encoding apparatus according to claim 2, wherein the high-frequency-band component encoder quantizes pitch lag information in the adaptive codebook based on the up-sampled signal of the decoded down-sampled linear-predictive residual signal.

5. A speech decoding apparatus, comprising:

a linear predictive coefficients de-quantizer that decodes quantized linear predictive coefficients;

a low-frequency-band component decoder that decodes a down-sampled linear-predictive residual signal by a pulse-code-modulation decoder and up-samples the down-sampled linear-predictive residual signal and outputs an up-sampled signal of the decoded down-sampled linear-predictive residual signal;

a high-frequency-band component decoder that decodes an error signal between a linear-predictive residual signal and the up-sampled signal of the decoded down-sampled linear-predictive residual signal by a code-excited-linear-prediction decoder, and outputs the decoded error signal; and a synthesis filter that synthesizes a decoded speech signal excited by a summation of the up-sampled signal of the decoded down-sampled linear-predictive residual signal and the decoded error signal.

6. A communication apparatus comprising the speech decoding apparatus according to claim 5.

7. A speech encoding method, comprising:

analyzing an input digital speech signal using a linear predictive analyzer and outputting linear predictive coefficients using linear prediction;

quantizing the linear predictive coefficients;

encoding a down-sampled linear-predictive residual signal by a pulse-code-modulation encoder and generating low-frequency-band component encoded information; and encoding an error signal between a linear-predictive residual signal and an up-sampled signal of a decoded down-sampled linear-predictive residual signal by a code-excited-linear-prediction encoder and generating high-frequency-band component encoded information.

* * * * *